US008210299B2

(12) United States Patent
Streeter

(10) Patent No.: US 8,210,299 B2
(45) Date of Patent: Jul. 3, 2012

(54) ADJUSTABLE MOUNTING BRACKET AND METHOD FOR SECURING A PART IN PLACE

(75) Inventor: Brent Streeter, Clarksville, TN (US)

(73) Assignee: Behr America, Inc., Troy, MI (US)

( * ) Notice: Subject to any disclaimer, the term of this patent is extended or adjusted under 35 U.S.C. 154(b) by 549 days.

(21) Appl. No.: 11/661,402

(22) PCT Filed: Aug. 30, 2005

(86) PCT No.: PCT/US2005/030770

§ 371 (c)(1),
(2), (4) Date: Dec. 20, 2007

(87) PCT Pub. No.: WO2006/026591

PCT Pub. Date: Mar. 9, 2006

(65) Prior Publication Data

US 2008/0185200 A1 Aug. 7, 2008

Related U.S. Application Data

(60) Provisional application No. 60/605,166, filed on Aug. 30, 2004.

(51) Int. Cl.
*B60K 11/04* (2006.01)

(52) U.S. Cl. ..... 180/68.4; 180/68.6; 165/67; 248/228.3; 248/231.41; 248/295.11; 248/297.21

(58) Field of Classification Search ..... 180/68.4, 180/68.6; 248/228.3, 231.41, 295.11, 297.21; 165/67

See application file for complete search history.

(56) References Cited

U.S. PATENT DOCUMENTS

| | | | | | |
|---|---|---|---|---|---|
| 1,760,346 | A | * | 5/1930 | Correa | 24/72.5 |
| 1,788,800 | A | * | 1/1931 | McGinley | 220/482 |
| 3,939,986 | A | * | 2/1976 | Pierro | 211/74 |
| 4,196,774 | A | * | 4/1980 | Hoffmann | 165/67 |
| 6,105,182 | A | * | 8/2000 | Elnar | 4/541.1 |
| 2002/0157810 | A1 | * | 10/2002 | Damson et al. | 165/51 |
| 2002/0157812 | A1 | | 10/2002 | Anderson et al. | |
| 2003/0146030 | A1 | * | 8/2003 | Harada | 180/68.4 |
| 2010/0090422 | A1 | * | 4/2010 | Chan et al. | 280/11.27 |

FOREIGN PATENT DOCUMENTS

| | | | | |
|---|---|---|---|---|
| DE | 41 24 361 | C1 | | 7/1992 |
| EP | 0 529 165 | A1 | | 3/1993 |
| EP | 1 253 394 | A2 | | 10/2002 |
| FR | 2 748 559 | A1 | | 11/1997 |
| FR | 2748559 | A1 | * | 11/1997 |
| JP | 63-261680 | A | | 10/1988 |
| JP | 8-261680 | A | | 10/1996 |
| JP | 08261680 | A | * | 10/1996 |
| JP | 2003-278546 | A | | 10/2003 |

* cited by examiner

*Primary Examiner* — J. Allen Shriver, II
*Assistant Examiner* — Bryan Evans
(74) *Attorney, Agent, or Firm* — Muncy, Geissler, Olds & Lowe, PLLC

(57) ABSTRACT

The invention relates to a mounting bracket (10), in particular for mounting a radiator (100). The bracket (10) comprises a stationary member (20) to be attached to the vehicle and a movable member (30) slideably mounted on the stationary member (20), preferably using guide rails (24*a*, 24*b*). The movable member (30) is configured to move from a first position to a second position to thereby secure the radiator (100). A ratchet mechanism (42) including teeth (42*a*) on the stationary member (10) may be provided to lock the movable member (30). An independent claim is included directed to a method for securing a vehicle component.

2 Claims, 15 Drawing Sheets

ADJUSTABLE MOUNTING BRACKET AND METHOD FOR SECURING A PART IN PLACE

BACKGROUND OF THE INVENTION

1. Field of the Invention

The present invention relates to a mounting bracket and, more particularly, to an adjustable bracket for mounting an automotive component.

2. Description of Related Art

Traditionally, brackets have been used to attach automotive components to vehicles and to substantially restrain movement of such components. For example, an automotive component such as a radiator can be fixed in place with a bracket. To install the bracket, one portion of the bracket is attached to the vehicle and another portion of the bracket is attached to the automotive component. Attachment of the bracket to the vehicle is typically accomplished using standard fasteners (e.g., bolts, screws, rivets). Similarly, the bracket can be attached to the automotive component using a standard fastener such as a bolt and/or a special tool.

One disadvantage of a conventional bracket is that such a bracket typically has a preformed shape and is designed to be installed at a predetermined location in the vehicle. Accordingly, a conventional bracket can only be used to secure an automotive component having dimensions that correspond to the shape and predetermined placement of the bracket. As a result, the conventional bracket is unable to accommodate components of varying size or components that deviate from specified dimensional tolerances. Moreover, conventional brackets are attached to automotive components using standard fasteners and/or special tools, which increases the manufacturing cost and assembly time because extra parts must be purchased and utilized on the assembly line.

SUMMARY OF THE INVENTION

One aspect of the present invention relates to a bracket for securing a vehicle component. The bracket includes a stationary member configured to be attached to a vehicle and a movable member slideably mounted on the stationary member. The movable member is configured to move from a first position to a second position to thereby secure the vehicle component.

Another aspect of the present invention relates to a bracket. The bracket includes a support member for attachment to a vehicle body and a clamping member mounted on the support member. The clamping member is slideably adjustable so that the clamping member can be adjusted to secure vehicle components of various sizes.

Another aspect of the present invention relates to a method for securing a vehicle component in place. The method includes providing a bracket that includes a stationary member and a moveable member slideably mounted on the stationary member; attaching the stationary member to a vehicle body in the vicinity of a vehicle component; moving the moveable member toward the vehicle component; discontinuing moving the moveable member when it contacts the vehicle component; and either automatically during the movement or subsequent to the movement, engaging a latching mechanism to substantially restrain movement of the vehicle component.

Another aspect of the present invention relates to a vehicle. The vehicle includes a module containing at least a radiator and a bracket including a stationary member configured to be attached to a vehicle and a movable member slideably mounted on the stationary member. The movable member is configured to move from a first position to a second position to thereby secure the module in place.

Yet another aspect of the present invention relates to a method for installing an automotive component in a vehicle. The method includes providing a module containing at least a radiator; installing the module in the vehicle; providing a bracket that includes a stationary member and a moveable member slideably mounted on the stationary member; attaching the stationary member to the vehicle so that the moveable member is positioned above a top surface of the module; moving the moveable member toward the top surface of the module until the moveable member contacts the top surface of the module; and activating a latching mechanism, either during the movement or subsequent to the movement, to retain the moveable member in contact with the top surface of the module.

BRIEF DESCRIPTION OF THE DRAWINGS

The accompanying drawings, which are incorporated in and constitute a part of this specification, illustrate preferred embodiments of the invention and together with the description, serve to explain principles of the invention.

DETAILED DESCRIPTION OF PREFERRED EMBODIMENTS

Reference will now be made in detail to presently preferred embodiments of the invention, an example of each being illustrated in the accompanying drawings. An effort has been made to use the same reference numbers throughout the drawings to refer to the same or like parts.

Figure 1A:
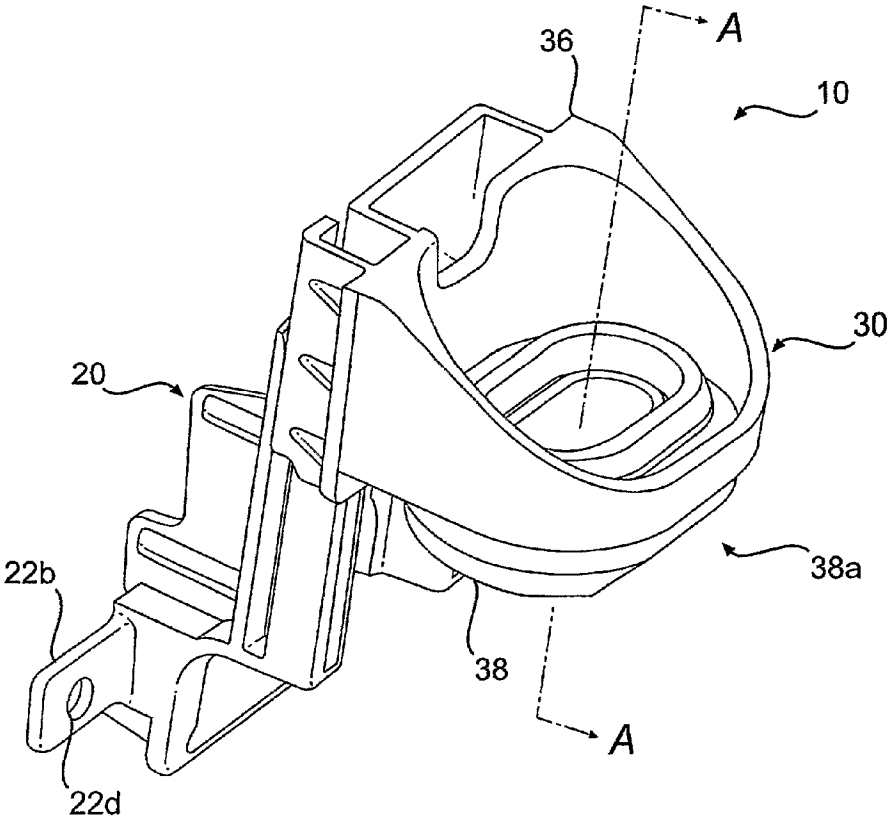
FIG. 1*a* is a perspective view of a first embodiment of a bracket according to the present invention.
Figure 1B:
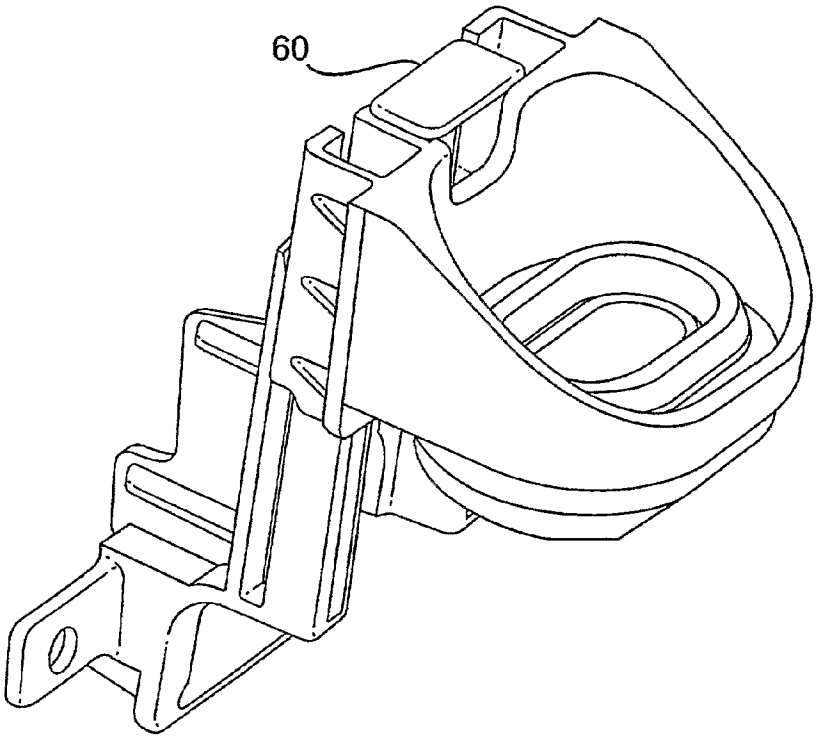
FIG. 1*b* is a perspective view of a second embodiment of a bracket according to the present invention.
Figure 2A:
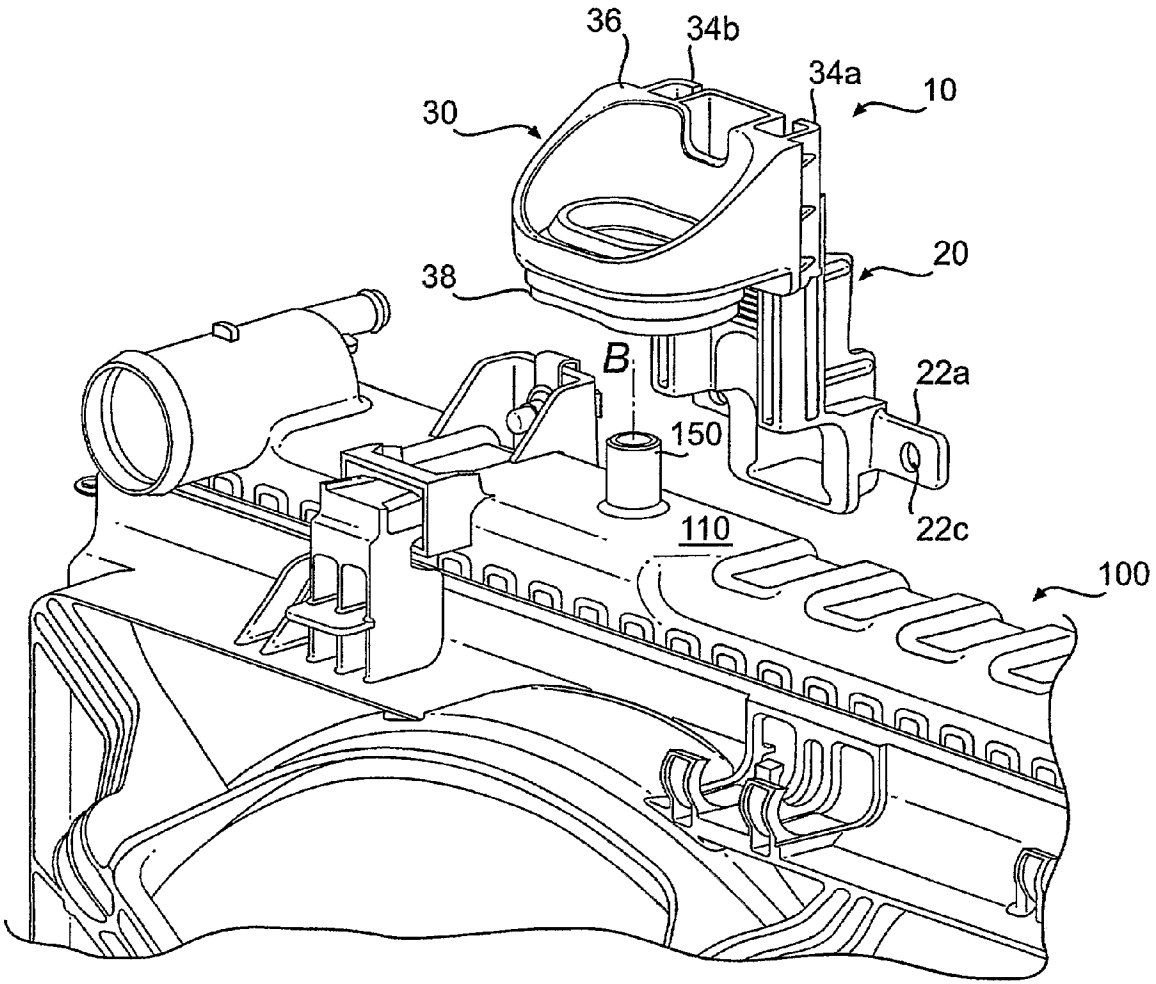
FIG. 2*a* is a perspective view of the bracket of FIG. 1*a* in an uninstalled position.
Figure 2B:
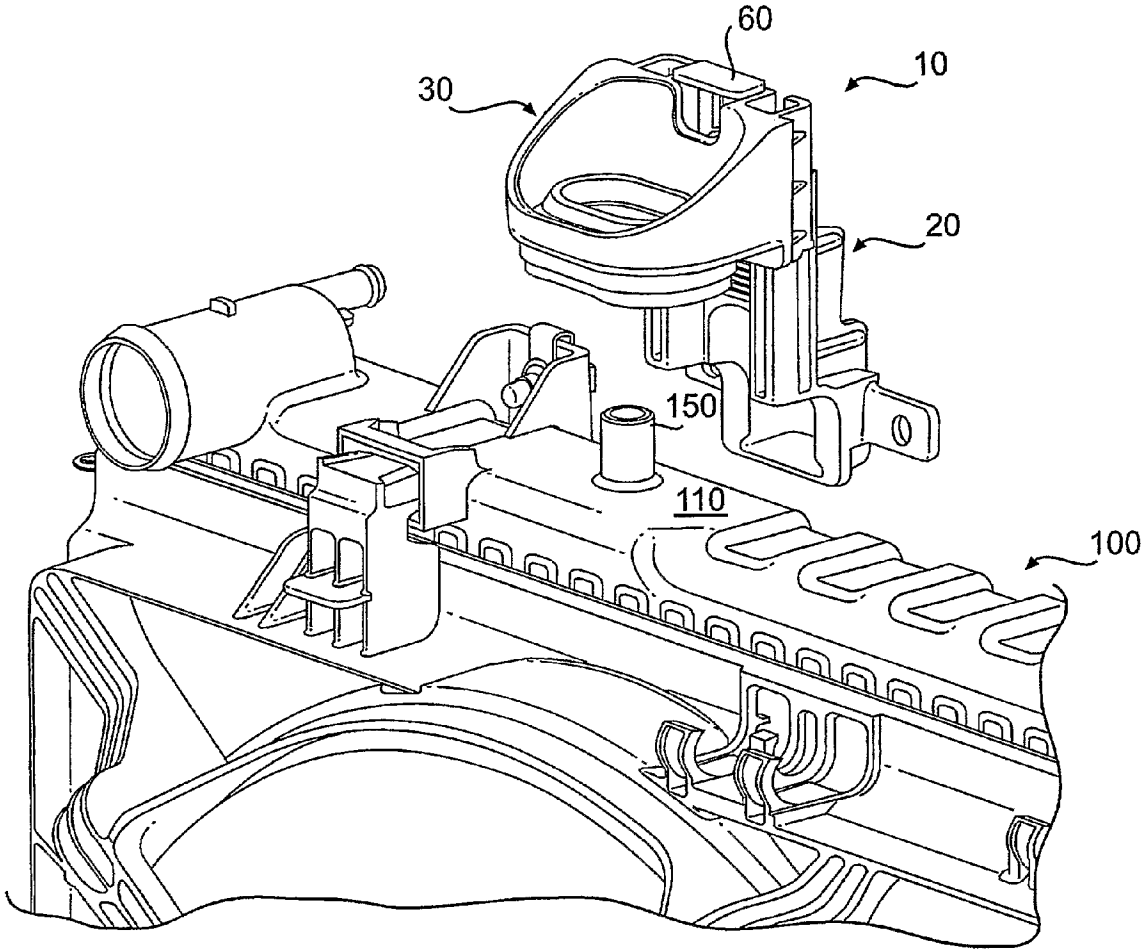
FIG. 2*b* is a perspective view of the bracket of FIG. 1*b* in an uninstalled position.
Figure 3A:
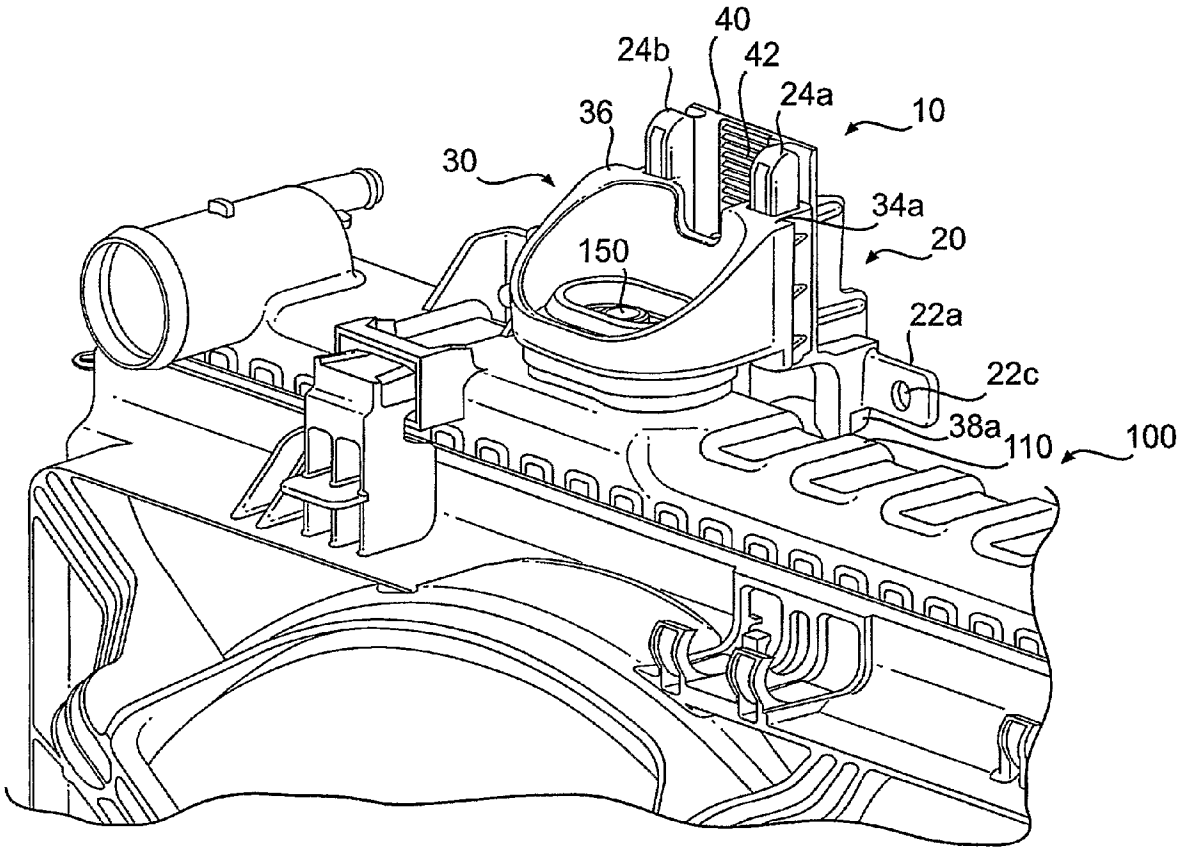
FIG. 3*a* is a perspective view of the bracket of FIG. 1*a* in an installed position.
Figure 3B:
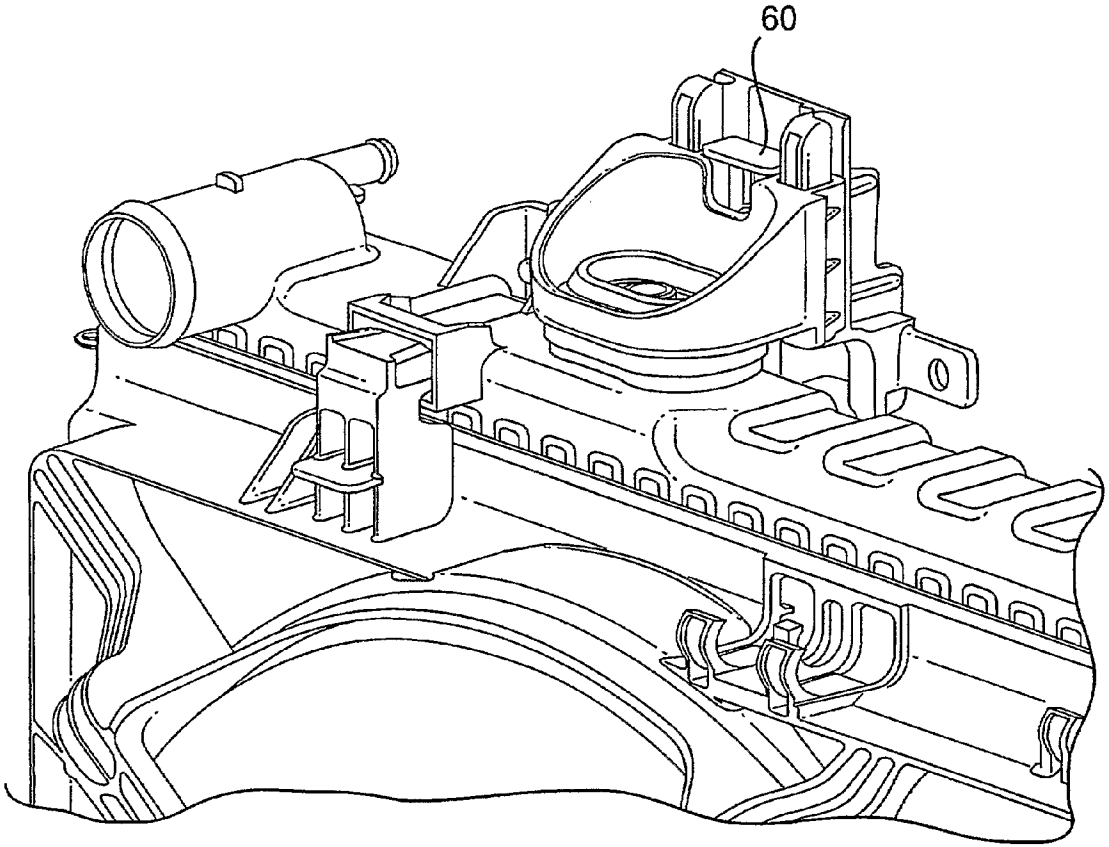
FIG. 3*b* is a perspective view of the bracket of FIG. 1*b* in an installed position.

FIGS. 1*a*, 2*a*, 3*a* and 5*a* show a first embodiment of a bracket 10 according to the present invention. FIGS. 1*b* through 5*b* show a second embodiment according to the invention. The bracket 10 is configured to secure an automotive (or vehicle) component 100 in position when the automotive component 100 is installed in a vehicle. As shown in FIGS. 1-3, the bracket 10 includes a stationary member 20, a moveable member 30, and a latch mechanism 40. The second embodiment, shown in FIG. 1*b*, differs from the first embodiment mainly by virtue of employing a separate locking member 60 to selectively engage the latch mechanism.

The stationary (or support) member 20 supports the moveable member 30 and is configured to be attached to a vehicle structure such as a vehicle frame or body. As shown in FIGS. 1 and 2, the stationary member 20 includes fastening members 22*a* and 22*b* for attaching the stationary member 20 to the vehicle structure. The fastening members 22*a* and 22*b* preferably include holes 22*c* and 22*d*, respectively, so that the fastening members 22*a* and 22*b* can be connected to the vehicle structure using standard fasteners such as bolts, screws, or rivets. Alternatively, the fastening members 22*a* and 22*b* can be attached to the structure by welding or bonding.

Figure 5A:
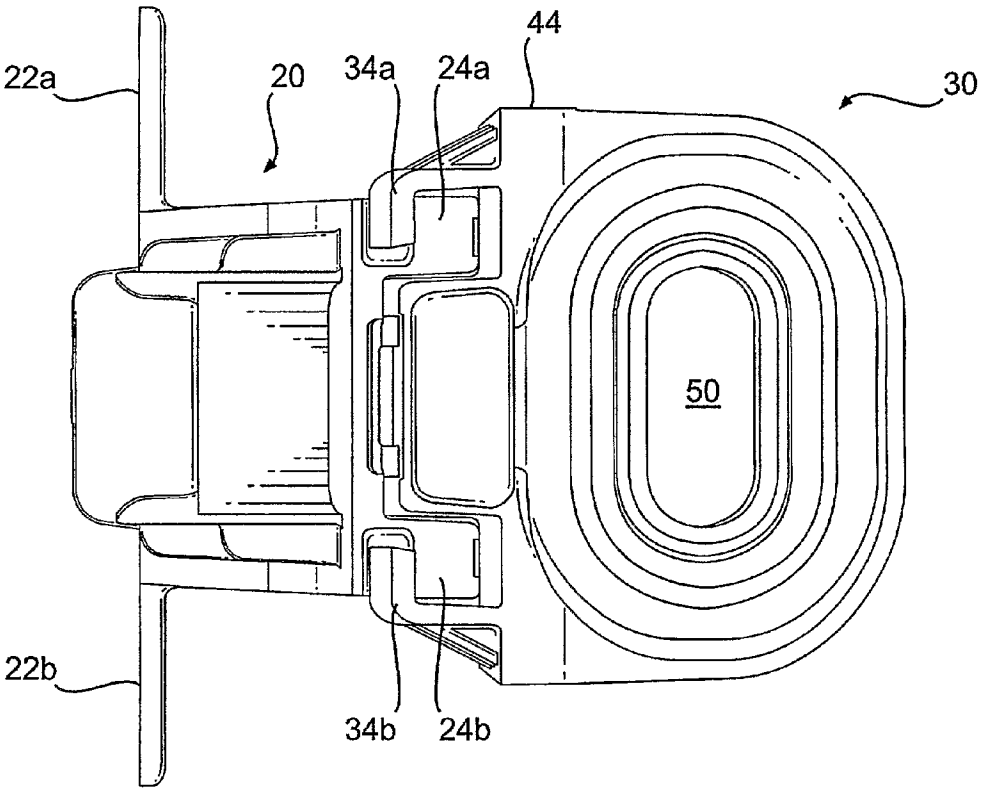
FIG. 5*a* is a top plan view of the bracket of FIG. 1*a*.
Figure 5B:
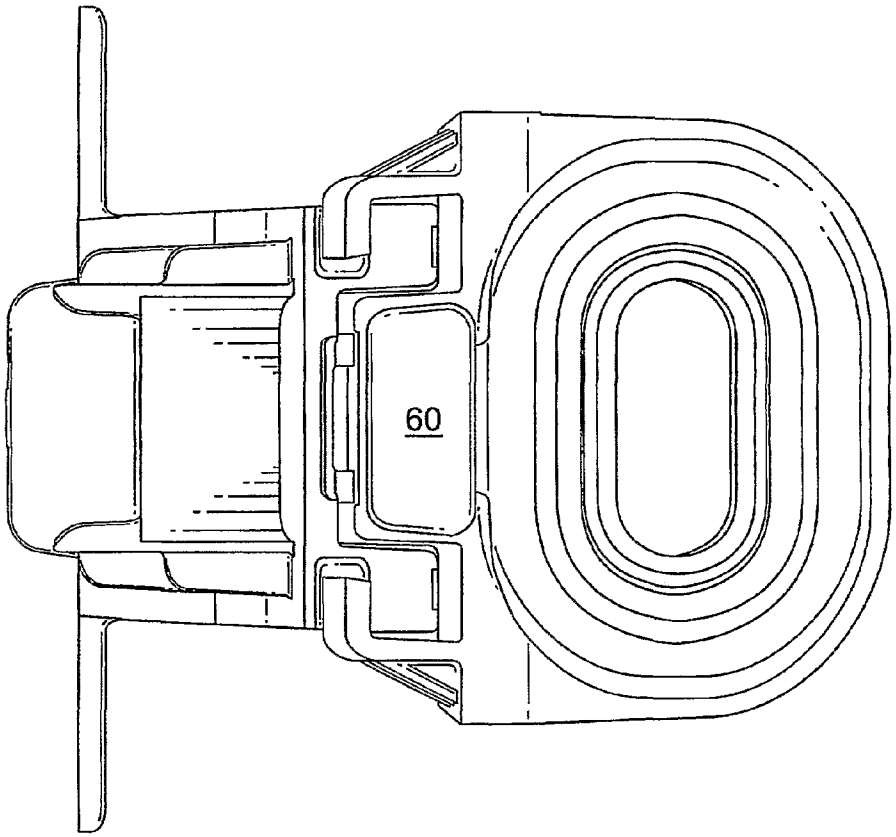
FIG. 5*b* is a top plan view of the bracket of FIG. 1*b*.
Figure 6A:
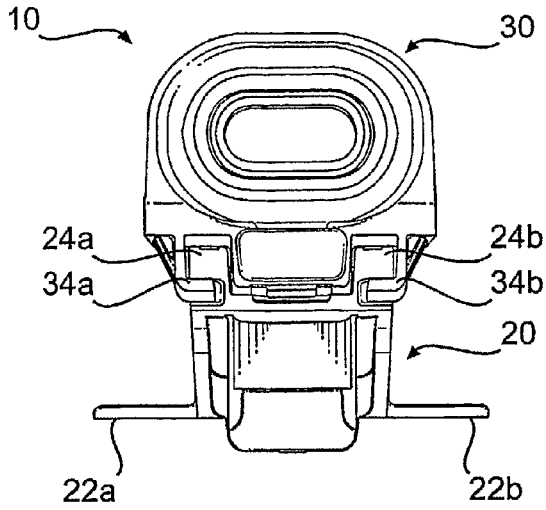
FIGS. 6*a* to 6*c* are detailed drawings showing details of the brackets of FIGS. 1*a* and 1*b*.
Figure 6B:
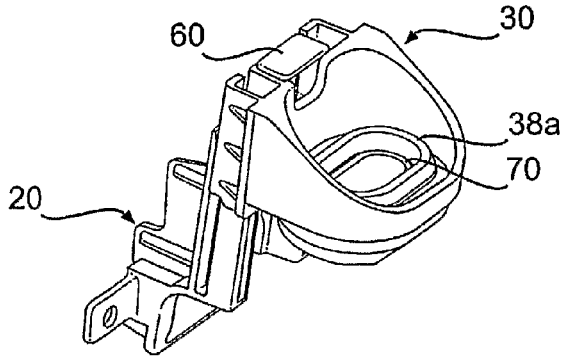
Figure 6C:
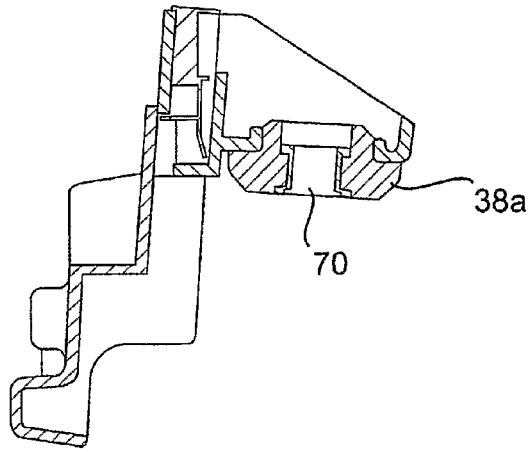
Figure 7A:
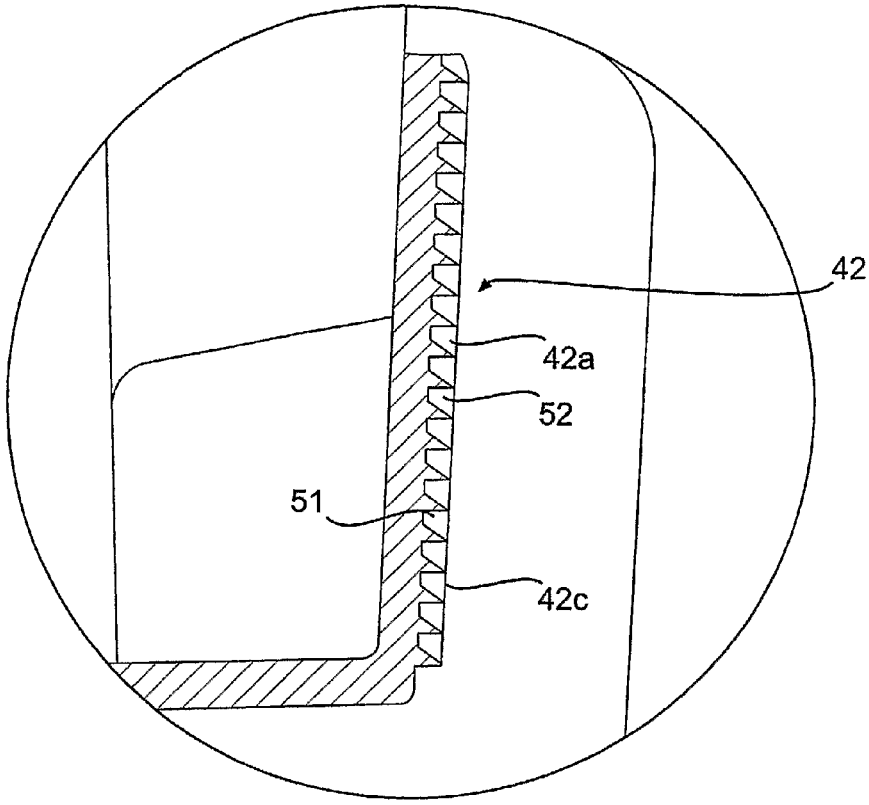
FIGS. 7*a* and 7*b* are drawings showing details of the stationary member of the bracket of FIGS. 1*a* and 1*b*.
Figure 7B:
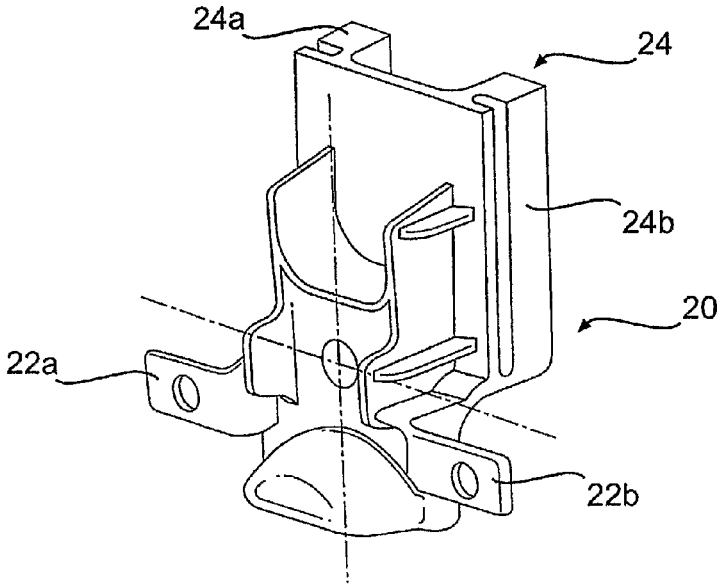
Figure 8A:
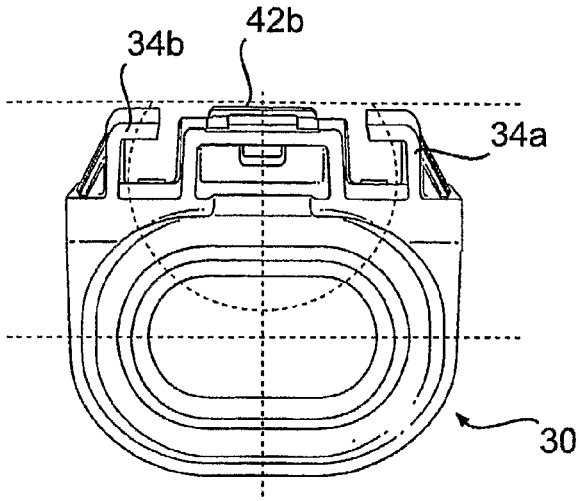
FIG. 8*a* is a top view and FIG. 8*b* is a perspective view showing details of the movable portion of the bracket of FIG. 1*a* and FIG. 1*b*.
Figure 8B:
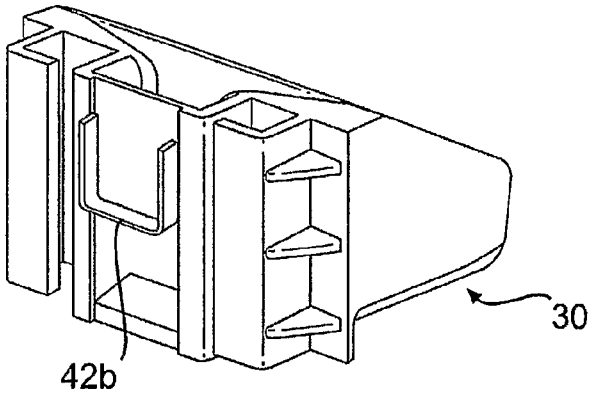
Figure 9A:
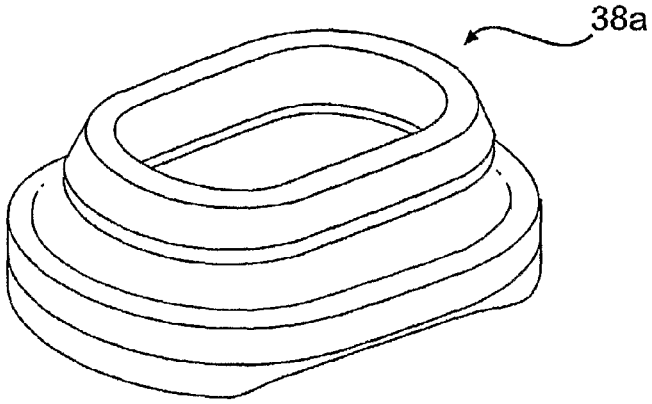
FIG. 9*a* is a perspective view and FIG. 9*b* is a cross-sectional view showing an isolator member of the bracket of FIG. 1*a* and FIG. 1*b*.
Figure 9B:
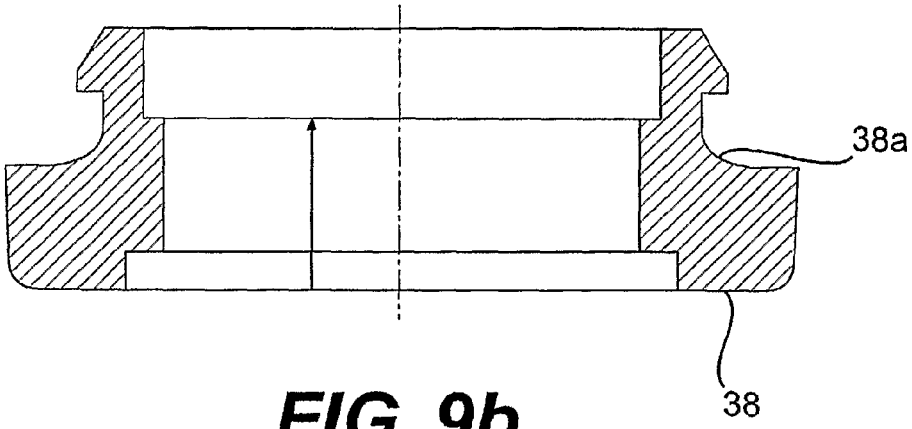

As shown in FIGS. 7 and 8, the stationary member 20 includes a mounting interface 24 that is configured to engage a corresponding mounting interface 34 on the moveable member 30 so that the moveable member 30 is supported on the stationary member 20. For example, the mounting interface 24 of the stationary member 20 may include a first guide rail 24*a* and a second guide rail 24*b* (shown in FIG. 7). Similarly, the mounting interface 34 of the moveable member 30 may include a first jaw 34*a* and a second jaw 34*b* (shown in FIG. 8). As shown in FIGS. 5 and 6, the moveable member 30 is mounted on the stationary member 20 by inserting the guide rails 24*a*, 24*b* into the jaws 34*a*, 34*b*, respectively. In this manner, the stationary member 20 supports the moveable member 30.

The moveable (or clamping) member 30 is mounted on the stationary member 20 so that a position of the moveable member 30 is adjustable relative to the stationary member 20. For example, the moveable member may be adjustable between a first position (shown in FIG. 2) in which the moveable member 30 is not contacting the automotive component 100 (i.e., an uninstalled position) and a second position (shown in FIG. 3) in which a contact surface 38 of the moveable member 30 is contacting a top surface 110 of the automotive component 100 (i.e., an installed position). Preferably, the moveable member 30 is slideably mounted on the stationary member 20 so that the moveable member 30 can move from the first position toward the second position. For example, the jaws 34*a*, 34*b* may be slideable along a length of the guide rails 24*a*, 24*b*. As a result, a height of the moveable member 30 is adjustable so that the bracket 10 can secure automotive components of various sizes and dimensional tolerances.

The moveable member 30 is adapted to be actuated from the uninstalled position to the installed position in a simple manner that does not require the use of special tools. For example, the moveable member 30 may be moved from the uninstalled position to the installed position by applying a force to an upper surface 36 of the moveable member 30 so that the moveable member 30 moves toward the automotive component 100. The force may be applied, for example, by a hand of a person or by a robot or a machine. The degree of force required to actuate the moveable member 30 will vary depending on the design of the bracket 10 and can be readily determined by one of skill in the art. In the case of the first embodiment of FIG. 1*a*, the force is typically greater than in the case of the second embodiment of FIG. 1*b*, as explained below.

The bracket 10 includes a latch mechanism 40 that may enable either one-way actuation of the moveable member 30 or two-way actuation of the moveable member 30. Specifically, the latch mechanism 40 in the first embodiment is configured to allow only one-way movement of the moveable member 30 in a direction toward the automotive component 100 (i.e., in a direction toward the second or installed position) and to prevent movement of the moveable member 30 in a direction away from the automotive component 100 (i.e., in a direction toward the first or uninstalled position). In this case, the latch mechanism 40 is activated automatically as the moveable member 30 moves along the stationary member 20 toward the installed position. For example, the latch mechanism 40 may include an ratchet mechanism 42 that is designed to be automatically engaging. The ratchet mechanism 42 has teeth 42*a* (shown in FIG. 7) disposed on the stationary member 20 and a projection 42*b* (shown in FIG. 8) disposed on the moveable member 30. Each tooth 42*a* includes an inclined surface S1 and a substantially straight surface S2. As shown in FIG. 8, the inclined surfaces S1 slope toward the installed position so that the projection 42*b* slides over an inclined surface S1 when sufficient force is applied to the upper surface 36 of the moveable member 30. After traversing an inclined surface of a tooth 42*a* or when application of the force is halted, the projection 42*b* snaps into a space 42*c* between adjacent teeth 42*a* and is prevented from moving back toward the uninstalled position by a surface S2. In this manner, the latch mechanism 40 allows the moveable member 30 to proceed in only one direction and can retain the moveable member 30 in a particular position. Thus, in one preferred embodiment, the bracket 10 includes an automatic latch mechanism 40 that operates automatically for one-way actuation of the moveable member 30 without the use of additional parts such as fasteners or special tools.

Figure 11:
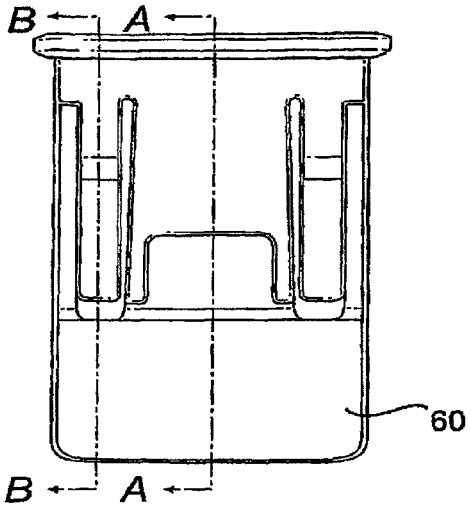
FIG. 11 is a front view of a preferred, optional locking member.
Figure 11A:
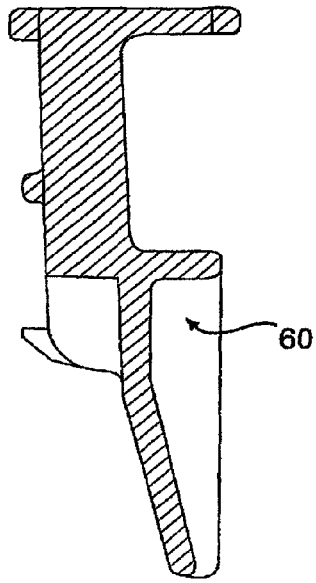
FIGS. 11*a* and 11*b* are cross-sectional views taken along the lines A-A and B-B, respectively.
Figure 11B:
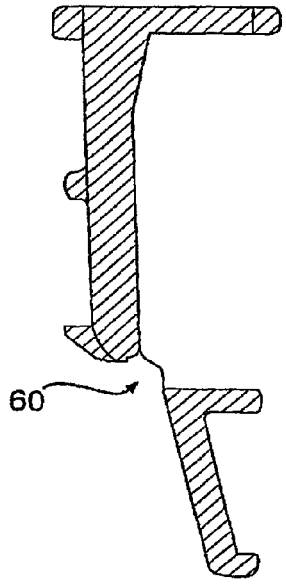

In the alternative second embodiment, the bracket 10 includes a selectively engageable latch mechanism adapted to be manually locked or activated (e.g., by a person or robot) to secure the moveable member 30 in a desired position. In the second embodiment shown in FIG. 1*b*, a separate locking member 60 is provided to selectively engage the latch mechanism 40 in its final latched condition when the moveable member 30 has reached its final position. In this embodiment, the projection 42*b* is oriented such that is either does not contact or engage with the ratchet teeth 42*a*, or so that it only lightly contacts teeth 42*a*. In this way, the moveable member can be moved more easily and optionally can be moved in both directions during mounting of a part or component. Only when the moveable member 30 is positioned in its final location is the locking member 60 inserted and/or fully inserted into the moveable member, in order to bias the projection 42*b* into (more) secure engagement with the teeth 42*a*. Details of one preferred locking member 60 are shown in FIGS. 11, 11*a* and 11*b*.

Of course, many other types of selectively engageable locking systems are conceivable. For example, other systems for selectively engaging the ratchet mechanism are conceivable. In another example, the selectively engageable locking mechanism could include at least one aperture disposed on the moveable member 30 and a plurality of corresponding apertures disposed on the stationary member 20. The moveable member 30 could be moved along the stationary member 20 until the aperture on the moveable member 30 aligns with an aperture on the stationary member 20 that is at the desired position. The manual latch mechanism could be activated by inserting a pin through the aligned apertures so that the moveable member 30 is retained relative to the stationary member 20. When a selectively engageable latch mechanism is employed, the moveable member 30 can be configured for one-way (i.e., one direction) or two-way (i.e., two direction) actuation.

The latch mechanism 40 may also include a release member for releasing or disengaging the latch mechanism 40. When the latch mechanism 40 is actuated, the moveable member 30 is released and can be freely moved along the stationary member 20 in either direction (i.e., in a direction toward the installed position and in a direction toward the uninstalled position). As shown in FIG. 5*a*, an optional release member 44 may be, for example, a lever configured to allow the projection 42*b* to disengage from a space 42*c*. In this manner, the bracket 10 can be readjusted after initial installment, e.g., to replace the mounted component. Alternatively, the bracket 10 may be configured for a single use so that readjustment of the bracket 10 is accomplished by breaking the bracket 10 to disengage the latch mechanism 40 and replacing the bracket 10 with a new bracket. In the case of the second embodiment, the locking member 60 can be removed in order to reposition the moveable member 30.

The stationary member 20 and the moveable member 30 may be formed of any material suitable for use in a vehicle application. For example, the stationary member 20 and the moveable member 30 may be formed of a polymer, a composite, or a metal. Preferably, however, the stationary member 20 and the moveable member 30 are formed of a nylon plastic.

Figure 4:
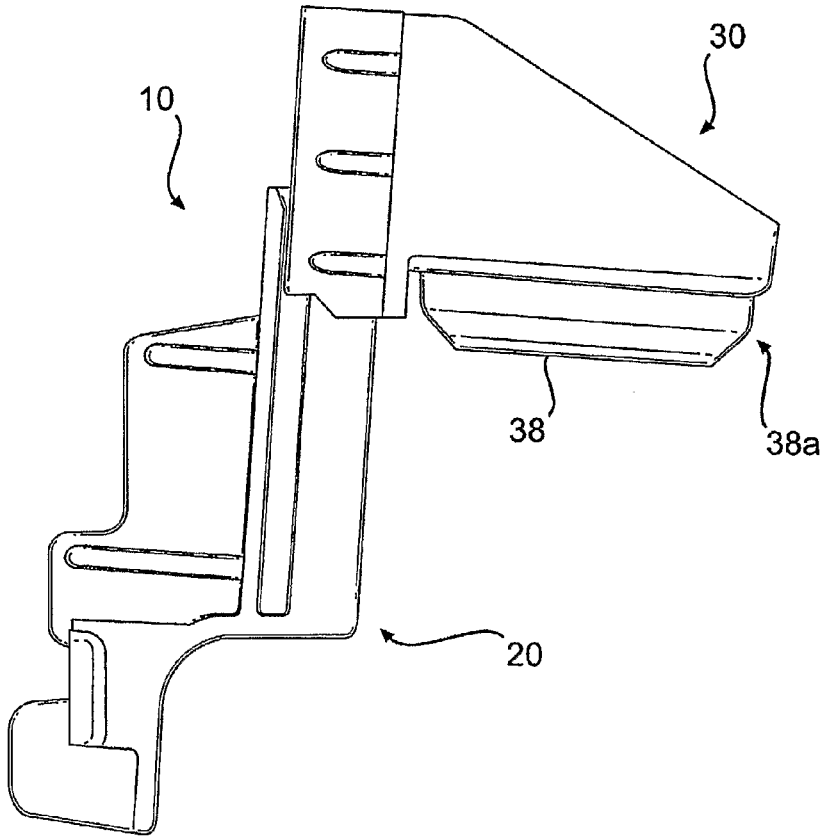
FIG. 4 is a side elevation view of the bracket of FIG. 1*b*.

As shown, e.g., in FIGS. 1 and 4, the moveable member 30 preferably includes an isolator member 38*a* having a clamping surface 38. When the moveable member 30 is retained in the installed position by the latch mechanism 40, the clamping surface 38 preferably contacts a top surface 110 of the automotive component 100 with sufficient force to securely stabilize (or fix) the component 100 in position so that movement of the component 100 is substantially restrained. The degree of force required to stabilize the component 100 depends on the automotive application and can readily be determined by one of skill in the art. Preferably, the clamping surface 38 and the isolator member 38*a* are formed of a polymer or rubber material. The material can also be selected so as to reduce the transmission of vibration through the isolator member 38*a*, i.e., by having a degree of resilience.

The moveable member 30 of the bracket 10 may include an aperture 50 that permits access to a portion of the automotive component 100 when the bracket 10 is in the installed position. For example, the top surface 110 of the automotive component 100 may include a connection 150 (e.g., for attaching a hose such as a coolant hose). To permit access to the connection 150 when the bracket 10 is in the installed position, the stationary member 20 is connected to the vehicle structure so that an axis A-A of the aperture 50 of the moveable member 30 substantially aligns with an axis B-B of the connection 150. Accordingly, when the moveable member 30 is moved into the installed position, the connection 150 is received in the aperture 50 (shown in FIG. 3) to enable access to the connection 150.

Figure 10:
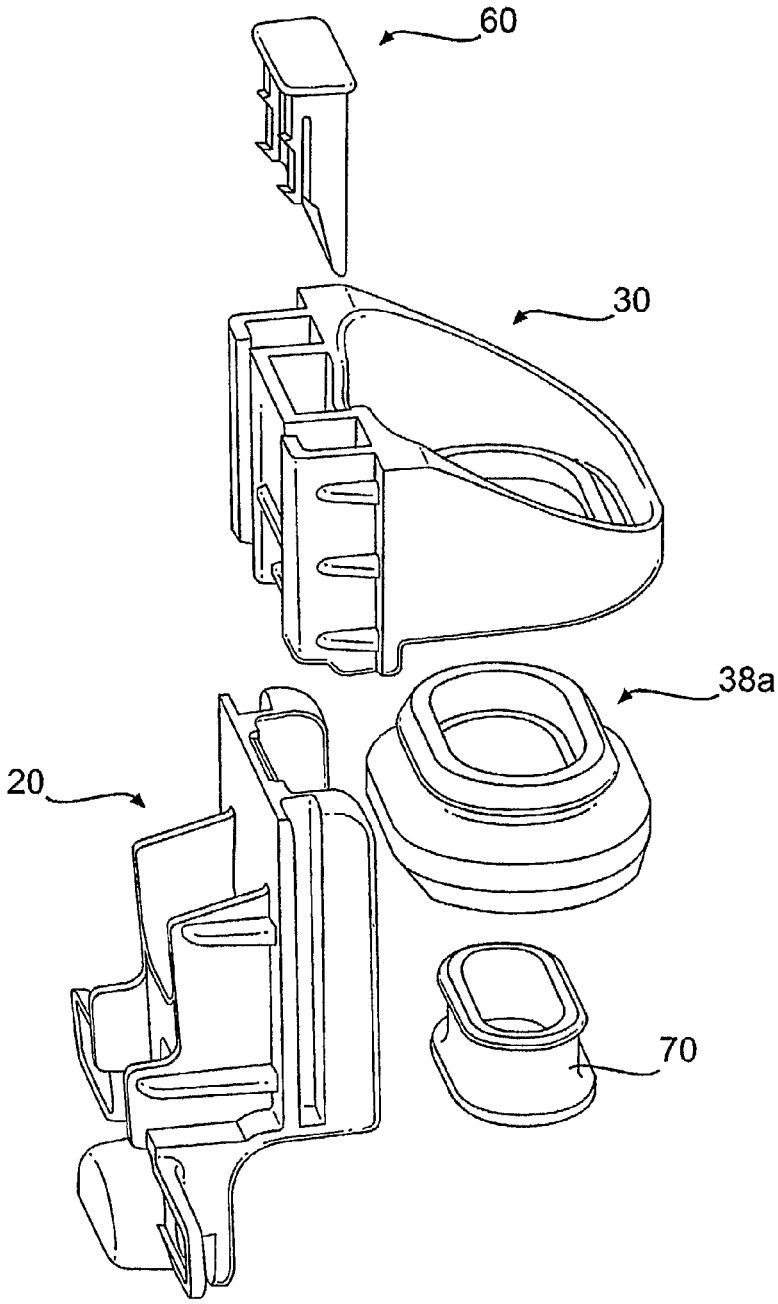
FIG. 10 is an exploded view of the bracket shown in FIG. 1*b*.
Figure 12:
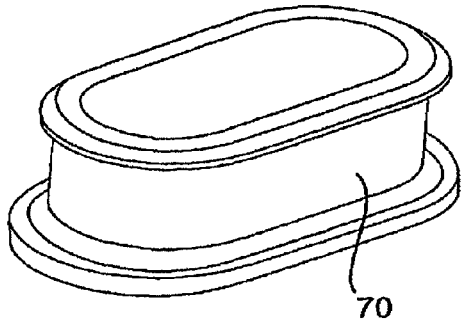
FIG. 12 is a perspective view of an optional insert member.

In certain applications for the moveable member having an aperture 50, it may also be desirable to include an optional insert that lines the aperture 50. Such an insert is shown in exploded FIG. 10 and also in FIG. 12. This insert is typically made of a more wear resistant material, such as a hard plastic, metal or composite material, since one reason to include such an insert is to prevent wear of the isolator member 38*a*.

In operation, the bracket 10 may be utilized to secure and stabilize the automotive component 100 in a vehicle. For example, the automotive component 100 (e.g., a module containing at least a radiator) is installed in a vehicle. The stationary member 20 of the bracket 10 is attached to the vehicle so that the moveable member 30 is positioned above the top surface 110 of the automotive component 100. A force is applied to the upper surface 36 of the moveable member 30 so that the moveable member 30 moves relative to the stationary member 20 toward the top surface 110 of the automotive component 100. Application of the force is continued at least until the contact surface 38 of the moveable member 30 contacts the top surface 110 of the automotive component 100. Preferably, application of the force is continued until the contact surface 38 is pressed against the top surface 110 of the component 100 with sufficient force to substantially restrain movement and/or stabilize the component 100. The latch mechanism 40 is activated (automatically or selectively) to thereby retain the moveable member 30 in contact with the top surface 110 of the automotive component 100.

In both the first and second embodiments, the two relatively moveable parts of the bracket can be initially connected to one another, e.g., by having the ratchet mechanism engaged in the first (or one of the initial few) tooth. This minimizes the number of separate parts to be handled during assembly or when supplying the assembly line. In the second embodiment, this initial connection can be either as a result of a partial or a complete insertion of the locking member 60, and or by providing differently configured teeth near the beginning of the row of teeth. Obviously, the locking member can optionally be removed, if desired, during adjustment of the bracket, but this is not necessary.

Thus, according to embodiments of the present invention, an adjustable bracket for securing automotive components of varying size and/or dimensional tolerance is provided. The adjustable bracket improves vehicle manufacturability and reduces cost by decreasing the number of parts and the assembly time required to install and secure an automotive component. Although the automotive component 100 shown in FIGS. 2 and 3 is a module that includes a radiator, a condenser, and a fan (i.e., a condenser radiator fan module or CRFM), the present invention is not limited to such modules. Rather, the invention applies to any automotive component that needs to be stabilized and/or securely fixed in place in a vehicle. Such automotive components include, for example, radiators, condensers, batteries, filter housings, coolant overflow reservoirs, fuel tanks, and electronic control modules.

Other embodiments of the invention will be apparent to those skilled in the art from consideration of the specification and practice of the invention disclosed herein. It is intended that the specification and examples be considered as exemplary only.

What is claimed is:

1. A bracket for securing a radiator, comprising:

a stationary member attached to a vehicle at a location adjacent to a radiator, the stationary member including first and second spaced rails; and a movable member movable relative to the stationary member while the stationary member is attached to the vehicle, the movable member comprising a body portion and first and second spaced channels, wherein the movable member is mounted on the stationary member for movement in a sliding direction with the first rail slidably retained in the first channel and the second rail slidably retained in the second channel from a first position spaced from the radiator to a second position pressing against the radiator, and wherein first and second rails are separated by a gap and wherein the movable member includes a projecting portion extending into the gap.

2. The bracket of claim 1 including a locking member extending, in the sliding direction, into an opening in the projecting portion.

* * * * *